United States Patent [19]

Harte

[11] 4,251,356

[45] Feb. 17, 1981

[54] APPARATUS FOR CLASSIFYING THE CONSTITUENTS OF A PNEUMATICALLY CONVEYED TOBACCO-CONTAINING STREAM

[75] Inventor: Heinz Harte, Hamburg, Fed. Rep. of Germany

[73] Assignee: Hauni-Werke Körber & Co., KG, Hamburg, Fed. Rep. of Germany

[21] Appl. No.: 5,709

[22] Filed: Jan. 23, 1979

[30] Foreign Application Priority Data

Feb. 6, 1978 [DE] Fed. Rep. of Germany ..... 2805017

[51] Int. Cl.[3] ..... B07B 7/06

[52] U.S. Cl. ..... 209/250; 209/31; 209/143; 209/281

[58] Field of Search ..... 209/21–23, 209/26–27, 240, 274, 281, 359, 250, 139 R, 143, 145, 30–35

[56] References Cited

U.S. PATENT DOCUMENTS

| | | | |
|---|---|---|---|
| 2,173,087 | 8/1939 | Eissmann | 209/139 R |
| 2,988,213 | 6/1961 | Davis et al. | 209/21 |
| 3,010,576 | 11/1961 | Harte et al. | 209/35 |
| 3,116,238 | 12/1963 | Van Etten | 209/250 |
| 3,265,210 | 8/1966 | Harte et al. | 209/143 X |

FOREIGN PATENT DOCUMENTS 165765 4/1950 Austria .

*Primary Examiner*—Ralph J. Hill
*Attorney, Agent, or Firm*—Peter K. Kontler

[57] ABSTRACT

The outlet of a pneumatic conveyor delivers a mixture of tobacco leaves and sand to the upper end of an arcuate duct which is located below a rotating air withdrawing wheel. That wall of the duct which faces the outlet of the pneumatic conveyor has holes for the passage of sand particles whereas the leaves descend in the duct and are evacuated by a cell wheel. The air withdrawing wheel draws air from the outlet of the pneumatic conveyor as well as from a suction chamber which is adjacent to the perforated wall of the duct and serves to collect the particles of sand. The rate at which the air flows from the suction chamber and/or the speed at which air flows from the outlet of the pneumatic conveyor is adjustable by pivotable flaps.

6 Claims, 1 Drawing Figure

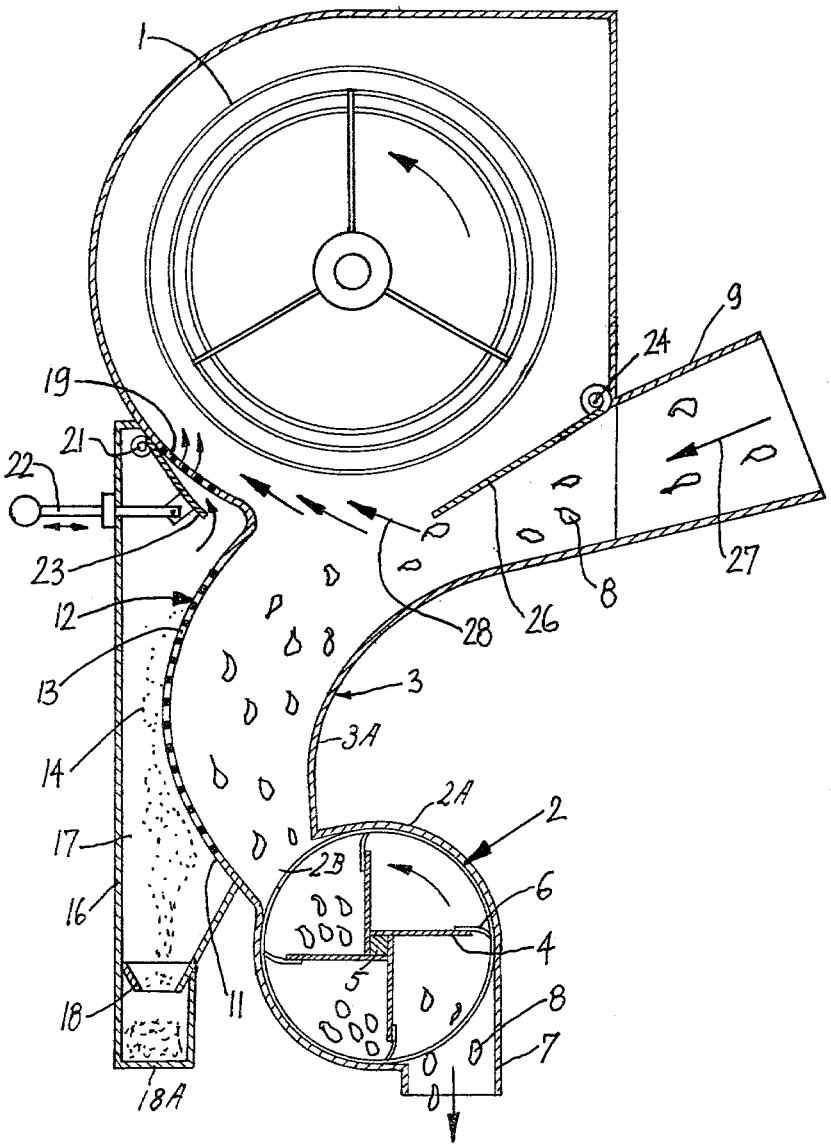
1
9
24
19
21
22
23
12
13
14
17
16
18
18A
11
28
26
8
27
3
3A
2A
2
2B
6
4
5
8
7

APPARATUS FOR CLASSIFYING THE CONSTITUENTS OF A PNEUMATICALLY CONVEYED TOBACCO-CONTAINING STREAM

BACKGROUND OF THE INVENTION

The present invention relates to apparatus for classifying the constituents of a tobacco-containing stream which is transported by a gaseous carrier medium. More particularly, the invention relates to improvements in apparatus for segregating relatively small particles of tobacco and/or other material from relatively large tobacco particles prior to introduction of larger particles into a further processing machine, e.g., into a shredding machine for tobacco leaves or into the distributor of a cigarette maker wherein the shreds are converted into a continuous rod-like tobacco filler. The particles which are to be separated from tobacco leaves or shreds may include sand, fragments of rock, short tobacco, tobacco dust and the like.

Many tobacco processing machines are coupled to each other by pneumatic conveyor systems. For example, shredded tobacco is often transported from one or more shredding machines to the next processing machine or machines in the form of a stream which is conveyed by a gaseous carrier medium, normally air. Upon arrival at the next processing station, the particles of the stream are separated from the carrier medium to be introduced into a hopper, magazine or another receptacle of the next processing machine. In many instances, the means for separating gaseous carrier medium from the particles of the stream comprises a rotary suction wheel which aspirates the carrier medium but prevents the entry of large solid particles into the path along which the carrier medium is withdrawn to be discharged into the atmosphere. It is desirable to separate the unwanted components of the stream simultaneously with segregation of gaseous carrier medium from the useful constitutents of the stream (i.e., from tobacco which is to be admitted into the next processing machine).

The situation is similar when the pneumatic conveyor system includes one or more pipes or tubes wherein the gaseous carrier medium circulates along an endless path to entrain particles of tobacco and other particles which are admitted into a first portion of the path and to be segregated from the particles on arrival of the particles into a second portion of the path. Such closed pneumatic conveyor systems are utilized when the gaseous carrier medium must be conditioned (e.g., by heating, cooling, raising the moisture content to a fixed level or reducing the moisture content to a predetermined level) because continuous conditioning of fresh supplies of a gaseous carrier medium would entail the consumption of excessive amounts of energy. The particles of tobacco are treated (e.g., dried, heated, cooled or moisturized) during transport along a portion of the endless path. As a rule, the gaseous carrier medium is cleaned (e.g., by passing through one or more filters) on its way from the second to the first portion of the endless path.

U.S. Pat. No. 3,116,238 to van Etten discloses a classifying apparatus wherein the outlet of the pneumatic conveyor discharges successive increments of the tobacco stream in a carrier medium into an arcuate channel which surrounds one side of an air-withdrawing wheel. The channel has a concave wall which is adjacent to the wheel and is perforated to permit the passage of dust. The particles of tobacco are intercepted and descend into an air lock. A drawback of such apparatus is that the perforations of the wall and the passages of the wheel are likely to be clogged with tobacco particles because the path of tobacco along such wall and along the wheel toward the air lock is relatively long. Moreover, the classifying action is not entirely satisfactory because the wall portion which faces the outlet of the pneumatic conveyor is not perforated.

Austrian Pat. No. 165,765 discloses an apparatus wherein the periphery of a rotary air withdrawing device is provided with a sieve which permits smaller particles, especially dust, to escape with the carrier medium. The particles of tobacco impinge upon a solid baffle and descend into an air lock. The sieve is cleaned by directing air from a portion of the interior of the air withdrawing device into the compartment which accumulates tobacco particles before the particles descend into the range of the air lock. A drawback of the patented apparatus is that substantial quantities of dust and other small particulate material escape with the carrier medium; therefore, such medium cannot be recirculated to the inlet of the pneumatic conveyor or it must be subjected to a very thorough and complex cleaning action. Moreover, a high percentage of dust and other small particulate material is likely to leave the apparatus with the acceptable material.

All presently known classifying apparatus which employ pneumatic conveyors exhibit the drawback that the classifying action is unsatisfactory, especially when the conveyor is to transport tobacco leaves whose specific weight is low. Such leaves cannot be readily separated from the carrier medium because their kinetic energy in the medium (normally air) is too low. Therefore, the leaves settle at the upstream side of a perforated wall or sieve and clog the orifices for the passage of air and/or tobacco dust. Such clogging is even more likely to occur when the path along which the leaves travel while in contact with the perforated wall is relatively long.

OBJECTS AND SUMMARY OF THE INVENTION

An object of the invention is to provide a novel and improved apparatus which can be used to transport a tobacco-containing stream in a gaseous carrier medium and wherein all valuable constituents of the stream can be segregated from the carrier medium in a simple and reliable way.

Another object of the invention is to provide an apparatus wherein the segregation of a gaseous carrier medium from the particles of tobacco takes place simultaneously with thorough and predictable separation of other constituents of the stream from the valuable material as well as from the carrier medium.

A further object of the invention is to provide an apparatus which can reliably separate tobacco leaves or shredded tobacco from a gaseous carrier medium as well as from tobacco dust, sand and other particulate material which should be segregated from tobacco prior to further processing of tobacco in a shredding machine, in a cigarette making machine or the like.

An additional object of the invention is to provide an apparatus whose output is high and which is less likely to become clogged with particles of tobacco than heretofore known apparatus.

Another object of the invention is to provide an apparatus which is capable of transporting and classifying the constituents of a tobacco-containing stream at a constant or highly predictable rate and wherein the segregated carrier medium contains a relatively low percentage of solid matter.

The invention is embodied in an apparatus for classifying the constituents of a stream consisting of larger and smaller particles wherein at least the larger particles consist of tobacco (for example, the larger particles may constitute tobacco leaves or shreds whose specific weight is rather low, and the smaller particles may include granular material of higher specific weight, such as sand, fragments of metal or rock and other impurities; furthermore, the smaller particles may include tobacco shorts and/or tobacco dust or other dust).

The apparatus comprises a pneumatic conveyor arranged to transport a stream of particles and a gaseous carrier medium along a predetermined path (which may include a portion of an endless path for the gaseous carrier medium) and having a discharge end, a gas separating device (e.g., a rotary wheel-shaped air separator) which is disposed at one side of the discharge end and communicates therewith to withdraw the carrier medium (or at least a high percentage of the carrier medium) from the path, a stationary classifying duct communicating with the discharge end of the pneumatic conveyor and having a perforated wall serving to intercept the larger particles of the stream while permitting the smaller particles to pass therethrough, and an air lock (e.g., a cell wheel) or analogous means for evacuating the larger particles from the duct.

The air separator is preferably located at a level above the evacuating means so that larger particles which enter the duct can descend therein by gravity to enter the evacuating means. The perforated wall is preferably disposed opposite the discharge end of the pneumatic conveyor and extends transversely of such discharge end. The discharge end of the pneumatic conveyor can be located in immediate proximity of and may be substantially tangential to the rotary separator.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a fragmentary sectional view of an apparatus which embodies the invention.

DESCRIPTION OF THE PREFERRED EMBODIMENTS

The drawing shows an apparatus which is used to transport tobacco leaves 8 by means of a gaseous carrier medium (normally air) and for segregation of the carrier medium from tobacco leaves before the leaves are transferred to the next processing station, e.g., to a shredding machine, not shown. The apparatus further serves to segregate tobacco leaves 8 from sand, tobacco dust and similar small solid particles (shown at 14) which form part of the tobacco-containing stream. Such stream, together with a stream of air, is delivered by a pneumatic conveyor whose discharge end is shown at 9 and which admits the stream of particles 8 and 14 in the gaseous carrier medium in the direction indicated by arrow 27. The upper side of the discharge end 9 is immediately adjacent to and substantially tangential to a rotary wheel-shaped air separating device or separator 1 which is driven to rotate in the direction indicated by arrow and has minute pores or slots for admission of air into its interior. The interior of the separating device or separator 1 communicates with the intake of a suction fan or the like, not shown. The directions in which the carrier medium leaves the discharge end 9 to flow into the interior of the separator 1 are indicated by arrows 28.

The separator 1 is located at a level above an air lock 2 here shown as a cell wheel which comprises a set of four equidistant blades 4 extending radially from a driven hub 5 and carrying flexible elastic flaps 6 which sealingly engage the internal surface of a cylindrical casing 2A having a tangential outlet pipe 7 for tobacco leaves 8. The blades 4 are driven to rotate in a counterclockwise direction, as viewed in the drawing. The discharge end 9 is connected with the inlet opening 2B of the casing 2A by an arcuate substantially vertical classifying duct 3 which diverges upwardly, not unlike a funnel, and has a non-permeable wall 3A constituting an extension of the lower portion of the discharge end 9 and a second wall 11 which is located opposite the discharge end 9 and includes a perforated portion or sieve 12 with holes 13. The concave side of the sieve 12 faces the interior of the duct 3 and the convex side of this sieve is adjacent to a suction chamber 17. The left-hand wall of the suction chamber 17 is shown at 16.

The position of the sieve 12 is selected in such a way that it is located in the path of movement of particles 14, i.e., of particles having a relatively high specific weight (as mentioned above, these particles may include sand, fragments of metal or rock and like substances). Such particles are sufficiently small to pass through the openings 13 and to enter the suction chamber 17 wherein they impinge upon the inner side of the wall 16 and descend through a funnel-shaped guide 18 into a collecting receptacle 18A.

The upper end portion of the sieve 12 is closely adjacent to the periphery of the rotating separator 1. The leaves 8 float in the interior of the duct 3 and descend into the casing 2A to be evacuated by the blades 4.

The upper end portion of the suction chamber 17 has openings 19 which are adjacent to the periphery of the rotating separator 1 and through which the separator draws air from the interior of the suction chamber. This insures that air which penetrates into the chamber 17 via holes 13 cannot stagnate therein. Moreover, such circulation of air through the suction chamber 17 promotes the passage of particles 14 through the sieve 12. A flap 23 which is pivotally connected to the side walls of the suction chamber 17 by a shaft 21 serves to regulate the rate of air flow from the chamber 17 toward the separator 1 via openings 19. The means for adjusting the position of the flap 23 includes a handle or lever 22 having a knob which is accessible to the attendant at the outside of the chamber 17.

The means for regulating the rate of air flow from the discharge end 9 toward the periphery of the separator 1 (i.e., for regulating the effective cross-sectional area of the discharge end 9) comprises a flap 26 which is disposed between the part 9 and the separator 1 and is pivotable on a horizontal shaft 24. The means for changing the angular position of the flap 26 may be identical with or similar to the adjusting member 22 for the flap 23. The pivotable end portion of the flap 26 extends into the interior of the apparatus, i.e., toward the sieve 12.

The operation is as follows

The mixture of particles 8 and 14 is conveyed in the direction indicated by arrow 27 and enters the upper end portion of the duct 3 by advancing along the underside of the flap 26. The angular position of the flap 26 determines the speed of the carrier medium for the mixture. The underside of the flap 26 directs the solid particles 8 and 14 toward the sieve 12, i.e., away from the periphery of the rotating separator 1. The kinetic energy of particles 14 is sufficiently high to cause such particles to reach the sieve 12 and to pass through the holes 13 in order to enter the suction chamber 17. The major part of the carrier medium flows in the direction of arrows 28, i.e., toward the periphery of the rotating separator 1, and is evacuated from the apparatus by the aforementioned suction generating device which draws air from the interior of the separator. Air which flows in the direction of arrows 28 entrains minute particles of tobacco dust and/or other small impurities. Such impurities can be readily separated from air if the latter is to be readmitted into the inlet (not shown) of the pneumatic conveyor which includes the discharge end 9.

At least some particles 14 advance straight toward and through the holes 13 of the sieve 12, i.e., they need not even rebound on impact against the concave side of the sieve. The leaves 8 float downwardly toward the casing 2A and are evacuated by way of the outlet pipe 7. Since the sieve 12 is relatively short, the leaves 8 can descend into the casing 2A prior to accumulating at the concave inner side of the sieve, i.e., they are not likely to clog the holes 13. The feature that the sieve 12 is relatively short, as considered in the direction of travel of tobacco leaves 8 toward the air lock 2, is attributable to the fact that the discharge end 9 admits the mixture of particles 8 and 14 into the space between the separator 1 and the air lock 2.

The suction chamber 17 prevents stagnation of air (namely, of that portion of the gaseous carrier medium which is not caused to flow in the direction indicated by arrows 28) in the interior of the duct 3. Such air is drawn through the holes 13 and is evacuated from the suction chamber 17 via openings 19 at a rate which is determined by the selected angular position of the flap 23. Air which escapes from the chamber 17 via openings 19 can be admixed to air which flows from the discharge end 9 in the direction of arrows 28 prior to entering the interior of the rotating separator 1.

An important advantage of the improved apparatus is that the path of particles 8 and 14 along the rotating separator 1 is relatively short. Thus, such particles would be free to advance toward the lower part of the separator 1 during movement across the gap between the flap 26 and the upper end portion of the wall 11. Since the kinetic energy of particles 14 is relatively high, they are unlikely to be deflected toward the periphery of the separator 1. Furthermore, the leaves 8 exhibit the tendency to advance into the duct 3 since the upper portion of this duct merges gradually into the discharge end 9, i.e., the leaves 8 also bypass the aforementioned gap and proceed toward the air lock 2. It has been found that even small particles of tobacco, i.e., fragments of leaves whose size is a fraction of the average size of leaves, are also highly unlikely to rise toward the periphery of the separator 1 so that the latter cannot become clogged with any constituents of the stream which is admitted via discharge end 9.

The position of the flap 23 will be changed to conform the rate of air flow via openings 19 to changes of several parameters, such as the rate of air flow from the discharge end 9 into the interior of the housing for the duct 3 and separator 1, the degree of contamination of the stream of tobacco leaves by impurities (14), the combined effective cross-sectional area of holes 13 in the sieve 12 and/or others. The adjustment will be such that the rate of flow of air from the chamber 17 via openings 19 will equal or approximate the rate of air flow into the chamber 17 via holes 13.

The flap 26 regulates the speed of the carrier medium which enters the apparatus via discharge end 9 as well as the direction of travel of particles 8 and 14 into and across the duct 3.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for classifying the contents of a stream including larger and smaller particles wherein at least the larger particles consist of tobacco, comprising a pneumatic conveyor arranged to transport a stream of particles and a gaseous carrier medium along a predetermined path and having a discharge end; a gas separating device at one side of and communicating with said discharge end to withdraw at least the major part of the carrier medium from said path but to allow the particles to remain in said path; a classifying duct communicating with said discharge end independently of the communication between said discharge end and said separating device to receive the particles from said path and having a perforated wall extending transversely of said discharge end and arranged to intercept said larger particles while permitting the smaller particles to pass therethrough, said wall being disposed opposite said discharge end so that the larger particles enter said duct from said path and are intercepted by said wall; means for evacuating the larger particles from said duct, said separating device comprising a rotary separator located at a level above said wall and said evacuating means, said discharge end of said pneumatic conveyor being substantially tangential to and adjacent said rotary separator; and means for varying the cross-sectional area of said discharge end, including a member immediately adjacent to said gas separating device and extending into said duct.

2. Apparatus as defined in claim 1, wherein said wall has a first side facing said discharge end and a second side, and further comprising a suction chamber adjacent to said second side of said wall.

3. Apparatus as defined in claim 2, wherein said suction chamber has at least one opening through which said gas separating device draws air from said suction chamber.

4. Apparatus as defined in claim 3, further comprising means for regulating the rate of the flow of gas from said chamber via said opening.

5. Apparatus as defined in claim 4, wherein said regulating means comprises a pivotable flap.

6. Apparatus as defined in claim 1, wherein said member of said varying means comprises a pivotable flap.

* * * * *